United States Patent [19]

Bleicher et al.

[11] Patent Number: 4,487,272

[45] Date of Patent: Dec. 11, 1984

[54] IMPACTING DRILL

[75] Inventors: Manfred Bleicher, Leinfelden; Wolfgang Schmid, Plattenhardt; Karl Wanner, Echterdingen, all of Fed. Rep. of Germany

[73] Assignee: Robert Bosch GmbH, Stuttgart, Fed. Rep. of Germany

[21] Appl. No.: 424,986

[22] Filed: Sep. 27, 1982

[30] Foreign Application Priority Data

Feb. 13, 1982 [DE] Fed. Rep. of Germany ..... 3205141

[51] Int. Cl.[3] ..... B25D 11/00

[52] U.S. Cl. ..... 173/48; 74/60; 173/109; 173/123; 192/89 A

[58] Field of Search ..... 173/13, 14, 18, 47, 173/48, 104, 109, 110, 111, 116, 128, 131, 123, 133, 139; 74/25, 60; 192/89 A, 96

[56] References Cited

U.S. PATENT DOCUMENTS

| | | | |
|---|---|---|---|
| 2,385,439 | 9/1945 | Gubbins | 173/13 |
| 2,824,455 | 2/1958 | Ristow et al. | 74/60 |
| 3,399,441 | 9/1968 | Imamura | 74/60 |
| 3,706,233 | 12/1972 | Sanz et al. | 74/25 |
| 3,785,443 | 1/1974 | Armbruster | 173/48 |
| 3,800,901 | 4/1974 | Blomstrom et al. | 192/89 A |
| 3,828,863 | 8/1974 | Bleicher et al. | 173/48 |
| 3,895,540 | 7/1975 | Davidson | 74/60 |
| 4,066,136 | 1/1978 | Wanner et al. | 173/48 |
| 4,280,359 | 7/1981 | Schmid et al. | 74/60 |

FOREIGN PATENT DOCUMENTS

| | | | |
|---|---|---|---|
| 2917475 | 4/1979 | Fed. Rep. of Germany . | |
| 2820128 | 11/1979 | Fed. Rep. of Germany | 173/104 |

*Primary Examiner*—Frank T. Yost
*Assistant Examiner*—Hien H. Phan
*Attorney, Agent, or Firm*—Michael J. Striker

[57] ABSTRACT

An impacting drill is equipped with an air cushion impacting mechanism and with a tumbling mechanism which is operative for reciprocating the impacting mechanism. The tumbling stroke of the tumbling mechanism and thus the reciprocating stroke of the impacting mechanism is adjustable from zero to a maximum. The tumbling mechanism includes a hub body which is mounted on a holding body rigid with a rotatable shaft. The holding body is centered on an adjustment axis which encloses an acute angle with the axis of the shaft. The hub body is mounted on the holding body for angular displacement about the adjustment axis with attendant adjustment of the tumbling range. Coupling elements connect the hub body with the holding body in the respectively selected angularly displaced position of the hub body on the holding body. There may be provided a stepping switching mechanism between the hub body and the holding body of the shaft, by which an axial displacement of the shaft is converted into angular displacement of the hub body about the holding body.

30 Claims, 15 Drawing Figures

1
2
3
4
5
6
7
8
9
10
11
12
13
14
15
16
17
18
19
20
22
41
51
52
53
54
55
56
57
58
59
60
61
62
II
II

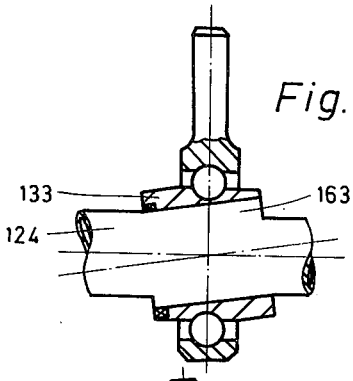
Fig. 10a
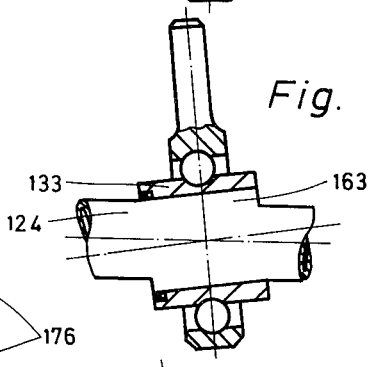
Fig. 10b
Fig. 9a
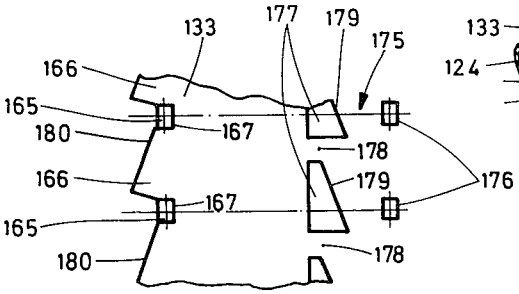
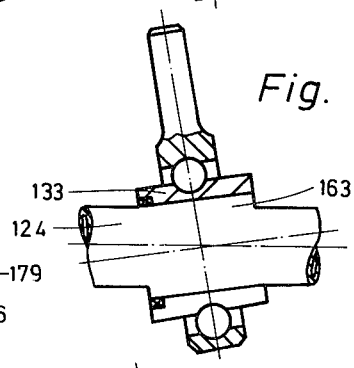
Fig. 10c
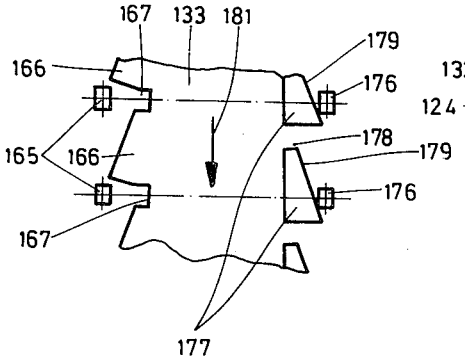
Fig. 9b
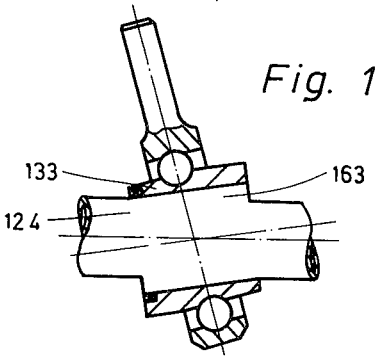
Fig. 10d

IMPACTING DRILL

BACKGROUND OF THE INVENTION

The present invention relates to impacting drills in general, and more particularly to impacting drills in which the impacting mechanism is selectively operatable.

There are already known various constructions of impacting drills, among them such which are equipped with an air cushion impacting mechanism and a tumbling mechanism that acts on the impacting mechanism to reciprocate the same in an adjustable manner during the operation of the impacting drill in the rotating and impacting mode. Conventional air cushion impacting mechanisms include an impacting element freely movable in the axial direction of the tool mounted in a chuck of the impacting drill, and a combination of a driving and a driven member which confine an air cushion between themselves. The tumbling mechanism then acts on the driving member to reciprocate the same in the axial direction of the tool and thus to impart impacts to the latter via the air cushion, the driven member, and the impacting element. The tumbling mechanism extends along a tumbling plane which revolves around an axis during the operation in the rotating and impacting mode and encloses an acute angle with such an axis. The adjustment of the operation is accomplished by varying the aforementioned acute angle.

An impacting drill of this type is known, for instance, from the published German patent application No. DE-OS 29 17 475. In this construction, the aforementioned driving member of the air cushion impacting mechanism is provided with a concentric annular groove and the tumbling mechanism includes a tumbling disc which has a peripheral portion that extends into such groove. The tumbling disc is mounted on an axially stationary shaft by means of a bolt extending transversely thereto, for pivoting about the axis of the bolt. A support disc having an inclined surface is mounted on the shaft at one axial side of the tumbling disc for joint rotation with the shaft but for displacement in the axial direction. The tumbling disc is pressed against the support disc by means of an axial compression spring which surrounds the shaft and is situated across the tumbling disc from the support disc. When the impacting drill is being used and is pressed by the user against a structure, a working cylinder of the impacting drill is displaced to a greater or lesser extent into the interior of the impacting drill, depending on the force with which the impacting drill or the tool thereof is being pressed against the structure. As a result of this displacement, the working cylinder abuts at the end face against the support disc and displaces the latter accordingly on the rotating shaft in dependence on the pressing force. This results in a change in the tumbling angle of the tumbling plane of the tumbling disc in dependence on the pressing force. Thus, a zero tumbling angle is obtained when the tool mounted in the impacting drill is disengaged from any structure to be drilled into, while a maximum tumbling angle results from the maximum pressing force.

The internal displacement of the working cylinder of this conventional impacting drill can be blocked by means of a shiftable switching arrangement having an internal abutment finger, thereby preventing displacement of the support disc out of the position corresponding to the zero tumbling angle and thus causing the impacting drill to operate in a so-called "impact-stop" mode, regardless of the pressing force.

Experience with the above-discussed construction of the impacting drill has shown that it has several drawbacks. Besides the problematical operative coupling between the tumbling disc and the working cylinder with the attendant play, noise, wear and reduced life span, this construction has an additional disadvantage which resides in the fact that the compression spring must fully accept the resulting mass and inertial forces. Accordingly, the compression spring must be made correspondingly strong, and so must the spring which restores the working cylinder into its initial position. The need for overcoming these spring forces results in a situation where the user must apply a relatively high force to the impacting drill when it is desired to operate in the rotating and impacting mode. Another disadvantage of this construction is that the adjustment of the tumbling angle is accomplished by means of the working cylinder of the air cushion impacting mechanism and its internal displacement, inasmuch as the axial dimension of the air cushion confined in the working cylinder becomes smaller with the increasing extent of the internal displacement, which runs contrary to the desired mode of operation of the air cushion impacting mechanism. When the latter is being operated with less than the maximum possible reciprocating stroke, all of the pressing force, which can be quite considerable under certain circumstances, is transmitted to the support disc. Consequently, the support disc is subjected to a high degree of wear. When the support disc is so mounted on the shaft that it can quite easily move in the axial direction, which would be favorable in terms of ease of handling of the impacting drill, there exists the danger that the support disc could become displaced in the axial direction of the shaft on its own, to thereby increase the reciprocating stroke beyond that corresponding to the pressing force.

SUMMARY OF THE INVENTION

Accordingly, it is a general object of the present invention to avoid the disadvantages of the prior art.

More particularly, it is an object of the invention to provide an impacting drill with an adjustable impacting stroke, which does not possess the disadvantages of the conventional impacting drills of this type.

Still another object of the present invention is to so construct the impacting drill of the type here under consideration as to be able to adjust the tumbling angle and thus the extent of impacting stroke independently of the pressing force and maintain the adjusted condition regardless of the magnitude of the pressing force.

It is yet another object of the present invention to so design the impacting drill of the present invention as to obtain a continuous or small increment adjustment of the tumbling angle from the maximum to substantially zero.

An additional object of the present invention is to develop an impacting drill of the above type in which the magnitude of forces acting on the various components during the reciprocation of the air cushion mechanism is kept to the minimum.

A concomitant object of the present invention is to devise an impacting drill which is simple in construction, relatively inexpensive to manufacture, easy to use, and reliable in operation nevertheless.

In pursuance of these objects and others which will become apparent hereafter, one feature of the present invention resides, in an impacting drill operative for rotating and selectively imparting impacts to a tool mounted thereon, in a combination comprising a support; an air cushion mechanism mounted on the support for reciprocation axially of the tool and operative for impacting the latter; and means for selectively reciprocating the air cushion mechanism, such reciprocating means including a shaft mounted on the support for rotation about an axis offset from the air cushion mechanism, a holding member rigid with the shaft and centered on an adjustment axis enclosing an acute angle with the shaft axis, means for rotating the shaft about the shaft axis, a tumbling mechanism mounted on the holding member for angular displacement about the adjustment axis between a plurality of angular positions and including a portion extending along a tumbling plane enclosing an acute angle with a plane normal to the adjustment axis into force-transmitting engagement with the air cushion mechanism, and means for so releasably connecting the tumbling mechanism to the shaft for joint rotation therewith in any of the angular positions that the tumbling plane rotates with the shaft and the portion of the tumbling mechanism swivels in a plane extending in the direction of reciprocation of the air cushion mechanism within an angular range depending on the angular position of the tumbling mechanism on the holding member and thus on the resulting angle enclosed between the tumbling plane and the axis of the shaft. Advantageously, the air cushion mechanism includes a driving member, an impacting member, and means for forming an air cushion between the driving and impacting member. In this construction, the aforementioned portion of the tumbling mechanism engages the driving member. It is further advantageous when the tumbling mechanism includes a ring-shaped tumbling member extending along the tumbling plane and around the shaft and having the aforementioned portion, a hub body mounted on the holding member of the shaft for the angular displacement about the adjustment axis, and means for so mounting the tumbling member on the hub body that the tumbling plane encloses the second-mentioned acute angle with the plane normal to the adjustment axis. Under these circumstances, the releasable connecting means releasably connects the hub body with the shaft.

When the impacting drill is constructed in the above-discussed manner, there are obtained certain advantages. One of the advantages is that the tumbling stroke is virtually steplessly adjustable from zero to maximum stroke. The adjustment of the tumbling stroke is simultaneously usable for the achievement of the so-called "impact-stop" mode of operation of the impacting drill, during which only "drilling" is being performed. During the use of the impacting drill, the pressing force applied by the user on the impact drill has no influence either on the tumbling stroke or on the axial dimension of the air cushion. Moreover, the axial dimension of the air cushion is not influenced by the adjustment of the tumbling stroke. The desired tumbling angle and thus the corresponding tumbling stroke can be selectively fixed by the user of the impacting drill while the latter is de-energized. Once the tumbling angle is fixed, it does not change during the use of the impacting drill due to the effects of the pressing force. No reciprocating masses are effective during the operation in the impact-stop mode. Furthermore, even the rotating masses are relatively small.

It is currently preferred to make the above-mentioned acute angles equal to approximately one-half of the maximum desired angular range of swivelling movement of the portion of the tumbling member. This has the advantage that the maximum angular range is obtained when the acute angles are added to one another in one of the angular positions, and zero angular range is obtained in another position in which the acute angles are subtracted. Advantageously, the acute angles amount substantially to 8.5°.

The hub body and the shaft with the holding member are advantageously displaceable relative to one another in the axial directions of the shaft, and the releasable connecting means includes respective sets of male and female formations respectively mounted on the shaft with the holding member and on the hub body and engageable with one another during relative displacement in one, and disengageable from each other during relative displacement in the other, of the axial directions. These formations may include rollers, balls, radially or axially extending claws or radially or axially extending teeth. There is advantageously provided means for biasing the shaft with the holding member and the hub body relative to one another in the one axial direction for holding the sets of formations in engagement with one another.

It is further advantageous when the hub body is mounted on the support for at most a limited movement in the axial direction of the shaft, when the shaft with the holding member is mounted on the support for the axial displacement relative to the hub body, when the spring means includes at least one spring acting on the shaft in the one axial direction, and when there is provided a switching mechanism movable between its inactive and active positions and engaging the shaft with the holding member and displacing the same against the action of the spring during its movement toward its active position. There is further provided means for limiting the extent of axial movement of the hub body, including either an abutment rigid with the support and extending into the trajectory of axial movement of the hub body, or an axial compression spring extending between the shaft with the holding member and the hub body, especially between the holding member and the hub body. A ball-shaped element interposed between the switching mechanism and the shaft and supported on the latter, especially by being seated in an axial opening or recess of the shaft, is advantageously being used for transmitting forces between the shaft and the switching mechanism.

According to a currently preferred aspect of the invention, the switching mechanism includes at least one switching eccentric operative for axially displacing the shaft in the other axial direction toward the inactive position. The switching mechanism advantageously includes a manually actuatable switching wheel having a set of protuberances on its periphery and rotatably supported on the support in such a position that the protuberances move in a trajectory interfering with the path of axial displacement of the shaft to displace the latter into its inactive position. The switching wheel is rotatable about an additional axis which is either parallel to and transversely offset from the shaft axis, or transverse to the shaft axis at the level of the latter. In the first instance, the protuberances protrude from the switching wheel in the axial direction, while they protrude from the switching wheel in the radial direction in the second instance.

The impacting drill further includes a chuck which is operative for mounting the tool on the support for rotation about the tool axis, and a transmission interposed between the chuck and the shaft and operative for angularly displacing the shaft about its axis relative to the hub body in response to manual turning of the chuck about the tool axis with the shaft being situated in its inactive position due to the action of the switching mechanism thereon. However, it is even more advantageous when a stepping mechanism is interposed between the hub body and the shaft with the holding member, this stepping mechanism being operative for converting the axial displacement of the shaft with the holding member relative to the hub body into stepped angular displacement of the hub body about the adjustment axis. The stepping mechanism is advantageously an integral part of the switching mechanism.

A particularly advantageous construction is obtained when, in accordance with a further facet of the present invention, the stepping mechanism includes axially or radially extending claws on the holding member and correspondingly configurated associated claws in the hub body each of which has an inclined flank engaged by the respective claw of the holding member during the displacement of the shaft with the holding member in the axial direction for angularly displacing the hub body about the adjustment axis by one step during each cycle of the axial displacement. The aforementioned claws are so situated relative to the formations that, in the active position in which the formations engage one another, the claws of the holding member are spaced by a predetermined distance from the inclined flanks of the associated claws of the hub body to engage the same only after relative axial displacement by at least the predetermined axial distance in the other axial direction, during which displacement the formations became disengaged from one another. Preferably, even the formations have respective inclined flanks. It is currently preferred for the claws and the formations of the hub body to be arranged in the interior of the hub body substantially at the opposite axial end portions of the latter. The inclined flanks of the formations and those of the claws of the hub body extend toward one another as considered in one circumferential direction.

According to a further advantageous concept of the present invention, there is provided an impacting drill operative for rotating and selectively imparting impacts to a tool mounted thereon, comprising a support; an air cushion mechanism mounted on the support for reciprocation axially of the tool and operative for impacting the latter; and means for selectively reciprocating the air cushion mechanism, including a shaft mounted on the support for rotation about and for axial displacement along an axis offset from the air cushion mechanism, means for rotating the shaft, a tumbling mechanism including a hub body mounted on the shaft for rotation therewith and for pivoting relative thereto about a pivot axis extending transversely of the shaft axis and a ring-shaped tumbling member surrounding and so mounted on the hub body as to extend along a tumbling plane including the pivot axis and rotating with the hub body, the tumbling member including a portion force-transmittingly connected with the air cushion mechanism and conducting swivelling movement within an adjustable angular range in a plane parallel to the reciprocation directions of the air cushion mechanism during the rotation of the tumbling plane, and means for adjusting the angular range, including a sleeve-shaped abutment member mounted on the shaft and retained against axial movement relative to the support, an axial compression spring surrounding the shaft across the hub body from the abutment member and bracing itself against the shaft and the hub body to urge the latter against the abutment member, and a switching mechanism operative for selectively axially displacing the shaft relative to the hub body to thereby vary the angle enclosed by the tumbling plane with the axis of the shaft. In addition to the above-discussed advantages, the impacting drill of this construction has the advantage of the fully stepless or gradual adjustment of the tumbling stroke. It is further advantageous that no wear can occur on any coupling elements even after numerous adjustments of the impacting stroke. The axial compression spring acts in the same direction as the mass forces and does not increase the limiting pressing force.

The novel features which are considered as characteristic of the invention are set forth in particular in the appended claims. The improved impacting drill itself, however, both as to its construction and its mode of operation, together with additional features and advantages thereof, will be best understood upon perusal od the following detailed description of certain specific embodiments with reference to the accompanying drawing.

BRIEF DESCRIPTION OF THE DRAWING

FIGS. 9*a* and 9*b* are fragmentary developed views of the cooperating parts of the holding body and the hub body in two different adjusted positions;

FIGS. 10*a* to 10*d* are fragmentary sectional views of the shaft and the hub body in different relative positions.

DETAILED DESCRIPTION OF THE PREFERRED EMBODIMENTS

Figure 1:
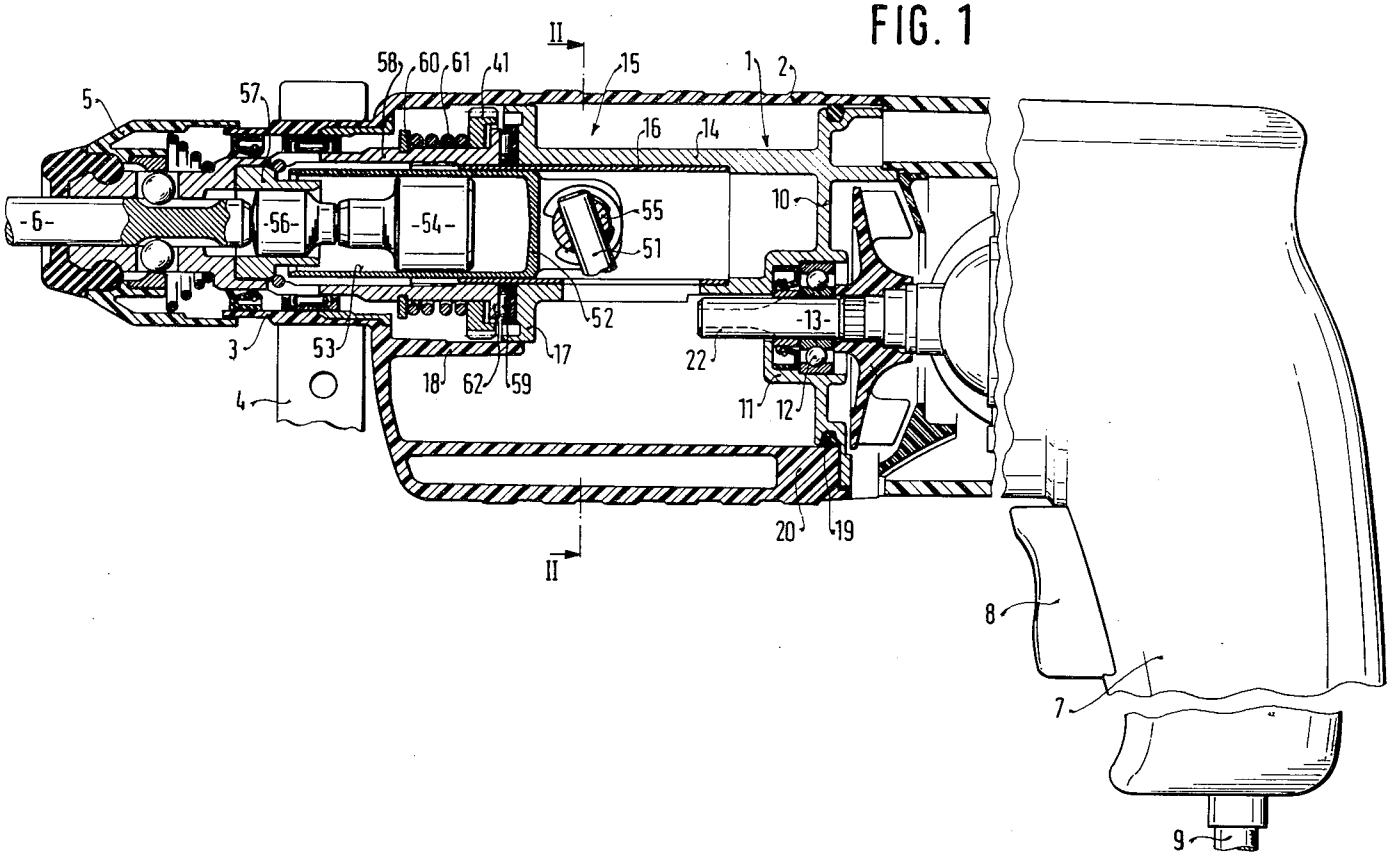
FIG. 1 is a partial axial sectional view of an impacting drill according to the present invention.

Referring now to the drawing in detail, and first to FIG. 1 thereof, it may be seen therein that it depicts an impacting drill or hammer-drill which includes a metallic transmission housing 1 which is accommodated in an outer shell 2 of synthetic plastic material. The synthetic plastic material shell 2 merges into a cylindrical housing extension 3 at its forward end as considered in the operating direction. The housing extension 3 serves, for instance, for the clamping of auxiliary equipment thereon. In the drawing, the auxiliary equipment is a handgrip 4. A tool holder or chuck 5 is arranged on the impacting drill at the forward end of the extension 3, which is constructed for receiving a variety of different tools which are not illustrated in the drawing, except for a shank 6 of one of such tools, such as a drilling tool. A pistol-type handgrip 7 is formed on the synthetic plastic material housing shell 2 at the rear end thereof which is remote from the tool holder 5. A switch having a depressable actuating button 8 is built into the pistol-type handgrip 7, this switch serving for controlling the energization and de-energization of the impacting drill. An electric current supply cable 9 passes through an elastic sleeve into the interior of the pistol-type handgrip 7 at the lower end of the latter as considered in FIG. 1.

The transmission housing 1 substantially consists of a transverse wall 10, in which there is substantially centrally arranged a bearing seat 11 for a frontward bearing 12 of an output shaft 13 of an electric motor. In the drawing, the bearing 12 is illustrated as a ball bearing. The electric motor, of which substantially only the frontward end of the output shaft 13 is shown in the drawing, is thus situated to the opposite side of the transverse wall 10 of the transmission housing 1 from the tool holder 5. The transverse wall 10 carries at its side facing away from the electric motor a tubular extension 14, in which there is arranged a cylindrical bushing 16 for an air cushion impact mechanism 15. At its frontward end which faces toward the tool holder 5, the extension 14 carries a flange 17 which supports the transmission housing 1 on its frontward end by engaging in a tubular fitting 18 provided in the interior of the housing shell 2. As may be seen in FIG. 1, the transmission housing 1 is supported at its other end on the inner surface of the housing shell 2, by means of the transverse wall 10. To this end, an O-ring 19 is accommodated in an annular groove provided at the outer periphery of the transverse wall 10. The O-ring 19 contacts the inner surface of the housing shell 2 with a slight pre-tension. In the axial direction, the transverse wall 10 is supported on abutments 20 which are formed by thickened portions of the respective walls of the housing shell 2.

Figure 2:
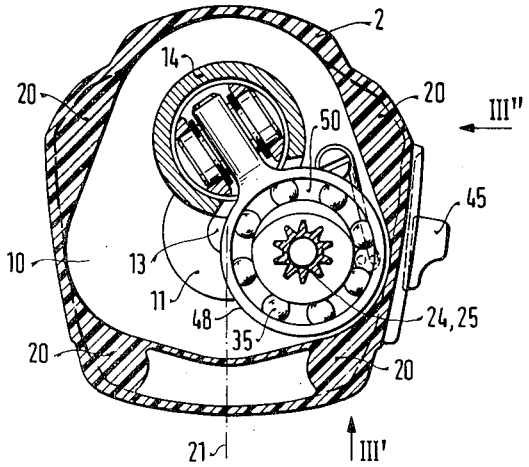
FIG. 2 is a cross-sectional view taken along the line II—II of FIG. 1.

It may best be seen in FIG. 2 of the drawing that the extension 14 and the bearing seat 11, in which the output shaft 13 of the electric motor is coaxially supported, are arranged in the longitudinal central plane 21 of the impacting drill. The end of the output shaft 13 which is supported in the ball bearing 12 carries a motor pinion 22. The motor pinion 22 meshes with a gear wheel 23 which is mounted on an intermediate shaft 24 for joint rotation therewith. The intermediate shaft 24, which is arranged at a lateral offset from the longitudinal central plane 21, is provided over its entire axial length with an external spline formation 25. The intermediate shaft 24 is supported at its end close to the transverse wall 10 in a grooved ball bearing 26. Inasmuch as the external spline formation 25 is turned off at the region of the grooved ball bearing 26, the intermediate shaft 24 is supported, by means of the thus obtained shoulder, at the inner race of the grooved ball bearing 26. The outer race of the grooved ball bearing 26 is held in a correspondingly configurated recess 26' which is formed in the transverse wall 10, as seen particularly in FIG. 3. Herein, the outer race of the grooved ball bearing 26 is so supported at the bottom of the recess 26' that any axial forces transmitted through the intermediate shaft 24 can be tranferred to the transverse wall 10. A bore 27 is coaxially provided in the end portion of the intermediate shaft 24 which is remote from the grooved ball bearing 26. A spring 28 is accommodated in the bore 27. A frontward end of a shaft part 29 extends out of the open end of the bore 27. The shaft part 29 is telescopically introducible into the bore 27 against the force of the spring 28. The free end of the shaft part 29 is, in turn, supported in a needle bearing 30. An end face of the shaft part 29 is held by the action of the spring 28 in the axial direction against a plate 32 arranged in a bearing receptacle 31 for the needle bearing 30. The bearing receptacle 31 is formed on the housing shell 2 which can be made, for example, of a glass fiber reinforced synthetic plastic material.

Figure 3:
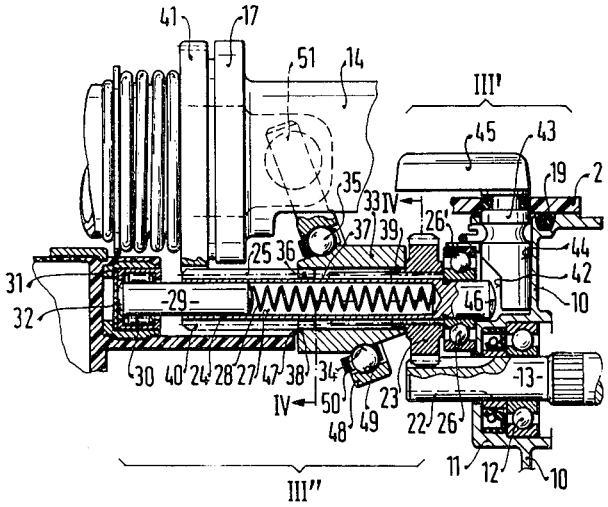
FIG. 3 is a fragmentary partially sectioned view of the transmission of the impacting drill in its developed state, as viewed in the directions of arrows III′ and III″ of FIG. 2.

A hub body 33 of a tumbling disk drive for the air cushion impact mechanism 15 is rotatably arranged on the intermediate shaft 24. The hub body 33 is provided at its outer periphery with a single guiding groove 34 for balls or spheres 35. The guiding groove 34 has an annular configuration and closes on itself, and extends along a plane which is inclined relative to the axis of the hub body 33. The hub body 33 is selectively couplable with and decouplable from the intermediate shaft 24 by means of positively engageable coupling elements. As the coupling elements, there serve, on the one hand, the external spline formation 25 of the intermediate shaft 24, and an annular internal spline formation 36 provided in the bore of the hub body 33 and extending into engagement with the external formation 25. In the coupled condition which is depicted in FIG. 3, a cut-away portion 37 is situated axially adjacent the internal spline formation 36 at the side thereof which faces toward the grooved ball bearing 26. The axial width of the cut-away portion 37 exceeds the width of the annular internal spline formation 36 of the hub body 33.

Figure 4:
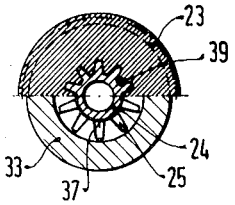
FIG. 4 is a cross-sectional view taken on line IV—IV of FIG. 3.

A driving gear wheel 23, which is provided with a corresponding internal spline formation, is supported on the end of the external spline formation 25 which is close to the grooved ball bearing 26, for joint rotation with but for axial displacement relative to the intermediate shaft 24. As can be seen in FIGS. 3 and 4 of the drawing, the splines of the external spline formation 25 have a reduced height as compared to that over the remaining portion of the intermediate shaft 24 at the region at which the hub body 33 and the driving gear wheel 23 are supported on the intermediate shaft 24. A transition 38 from the reduced to the unreduced height of the splines of the external spline formation 25 constitutes an axial abutment for the hub body 33 at the side of the latter which faces away from the driving gear wheel 23. Of course, the bore in the hub body 33 is fitted to the reduced spline height of the external spline formation 25 at least at the region of the annular internal spline formation 36. In this manner, the hub body 33 is supported, on one of its sides, on the intermediate shaft 24, by means of the internal spline formation 36. On its other side, the hub body 33 is supported on an axially protruding collar 39 of the driving gear wheel 23. In the position illustrated in FIG. 3, in which the coupling elements 25 (the external spline formation) of the intermediate shaft 24 engage the cooperating coupling elements 36 (the internal spline formation) of the hub body 33, the spring 28, in the final analysis, couples the intermediate shaft 24 with its axial abutment (the transition 38) with the hub body 33. In turn, the hub body 33 is supported in the axial direction on the driving gear wheel 23 which rests against the inner race of the grooved ball bearing 26.

The external spline formation 25 of the intermediate shaft 24 has the shape of a spline formation which is suitable for the transmission of rotational motions. Thus, advantageously, the splines have involute profiles. As a result of this, the frontward portion of the external spline formation 25 which is remote from the grooved ball bearing 36 and which has an unreduced spline height can serve as a driving pinion 40 of the intermediate shaft 24. This driving pinion 40 meshes with a driving gear wheel 41 which ultimately drives the tool clamped in the tool holder 5, that is, the shank 6 thereof, in rotation about its axis.

In the position illustrated in FIG. 3, the hub body 33 is in its coupled position, in which it is driven in rotation by the intermediate shaft 24. Now, in order to interrupt or discontinue the rotational connection between the intermediate shaft 24 and the hub body 33, that is, ultimately to put the air cushion impacting mechanism 15 out of operation, the intermediate shaft 24 must be displaced in the frontward direction, that is, toward the tool holder 5. To this end, there is provided switching means that are accessible from the exterior of the shell 2 and which render possible this de-coupling of the impacting mechanism 15. Such switching means is constructed as an eccentric 42 mounted on a switching shaft 43. The switching shaft 43 is guided in a bearing bore 44 which is dedicated thereto and is provided in the transverse wall 10 of the transmission housing 1. In the operating position of the impacting drill, the axis of the switching shaft 43 and thus also that of the bearing bore 44 extends horizontally. As seen in FIGS. 2 and 3, the switching shaft 43 has at its outer end which extends out of the housing 1 of the impacting drill an actuating knob 45'. As shown in FIG. 3, the switching eccentric 42 is so configurated that it does not contact a part-spherical rear end 46 of the intermediate shaft 24 which extends out of the grooved ball bearing 36, in the position in which the impacting mechanism is in operation. Only as the actuating knob 45 is turned out of its position illustrated in FIG. 3 through 180° does the outer surface of the switching shaft 43 come in contact with the part-spherical end 46 of the intermediate shaft 24, so that the latter is finally displaced against the force of the spring 28 in the frontward direction. As a result of this displacement, the above-mentioned clamping of the hub body 33 through the gear wheel 23 ultimately with the housing 1 of the impacting drill is discontinued. During the frontward displacement of the intermediate shaft 24, the front end face of the hub body 33 comes into contact with an abutment 47 constituted by a part of the machine housing. In this manner, the axial displacement of the intermediate shaft 24 is limited. During the aforementioned axial displacement of the intermediate shaft 24, the internal spline formation 36 of the hub body 33 is eventually disengaged and removed from the external spline formation 25 of the intermediate shaft 24, and is displaced into the cut-away portion 37. In this manner, the rotational connection between the intermediate shaft 24 and the hub body 33 of the tumbling disc drive has thus been discontinued. However, the intermediate shaft 24, which continues its rotation, continues to drive the gear wheel 41 in rotation, so that pure drilling operation can be accomplished with the impacting drill. The switching eccentric 42 is, therefore, loaded in the axial direction by the spring 28 only when the air cushion impact mechanism is switched off, that is, when no loads originating thereat are transmitted to the machine. When the air cushion impacting mechanism is switched on, the switching eccentric 42 is fully freed from the force of the spring 28. The force of the spring 28 is fully available for the elimination of the axial play of the hub body 33. In this manner, there is obtained, on the one hand, a minimum noise generation. On the other hand, there is achieved, due to the elastic clamping of the hub body 33 against the housing of the impacting drill, a complete freedom from axial play, whether the latter be attributable to machining tolerances or to the occurrence of wear.

An external guiding groove 49, which is cut into the internal surface of a ring 48, is associated with the guiding groove 34 provided on the hub body 33. The balls 35 are guided between the external guiding groove 49 and the guiding groove 34. In order to keep the balls 35 at a predetermined distance from one another, they are guided in a cage 50 which has a construction known from conventional ball bearings. A tumbling finger 51 is integrally formed on the ring 48. The tumbling finger 51 drives the air cushion impacting mechanism 15 of the impacting drill to and fro in a reciprocating movement.

The impacting mechanism 15 of the impacting drill is accommodated in the interior of a stationary support bushing 16 arranged in the tubular extension 14. The impacting mechanism 15 includes a cup-shaped piston 52 which is fittingly and slidingly guided in the support bushing 16, and an impacting element 54 which is also fittingly and slidingly arranged in a cylindrical bore 53 of the cup-shaped piston 52 and which is constructed for operation as a floating piston. The rear end of the cup-shaped piston 52, which extends away from the tool holder 5, has a bifurcated configuration, and it carries a pivot bolt 55. A transverse bore is arranged centrally in the pivot bolt 55. The tumbling finger 51 extends into this transverse bore of the pivot bolt 55 with a small play. As a result of this, the tumbling finger 51 is able to easily move in the axial direction in the transverse bore of the pivot bolt 55. An inner end of an intermediate member 56 extends into the frontward end of the bore 53 which is remote from the tumbling finger 51. The intermediate member 56 is guided in a support sleeve 57 for axial movement. The front end of the intermediate member 56 contacts the inner or rear end of the shank 6 of the tool, which is held in the tool holder 5 for axial movement but without freedom of rotational movement relative thereto, in a manner which is conventional and, therefore, has not been depicted in the drawing in any detail.

The supporting sleeve 57 is, in turn, secured in the interior of a rotatable sleeve 58 which is guided in the housing extension 3 for rotation in a manner which is not shown in the drawing in any detail. The rear end of the rotatable sleeve 58 is supported, through an axial or thrust needle bearing 59, on the flange 17 of the extension 14 of the transverse wall 10 of the transmission housing 1. In the radial direction, the rotatable sleeve 58 is guided, at its rear region which is closer to the needle bearing 59, on the end of the support bushing 16 which projects out of the extension 14. A gear wheel 41 is guided on the cylindrical outer surface of the rotatable sleeve 58 for rotation, and meshes with the intermediate shaft 24. The body of the gear wheel 41, which has on its motor-side end face respective coupling claws, is held in engagement with associated coupling claws provided on a rear flange 62 of the rotatable sleeve 58, by means of a compression spring 61 which is supported on a retention ring 68 that is inserted in an associated groove of the rotatable sleeve 58. The strength of the compression spring 61 is herein so selected that the gear wheel 41 is connected by means of the coupling claws in engagement with the rear flange 62 of the rotatable sleeve 58 at normal drilling torques. The rotational connection between the gear wheel 41 and the rotatable sleeve 58 is interrupted only when a predetermined limiting torque is reached.

A rotational movement of the hub body 33 results in a to and fro reciprocatory movement of the cup-shaped piston 52, as will easily be appreciated. The impacting element 54 is also caused to reciprocate to and fro in the axial direction, due to the action of an air cushion which is formed between the cup-shaped piston 52 and the impacting element 54 and which acts as an energy storage. The impacting element 54 releases its energy on hitting the inner end of the intermediate member 56. This released energy is eventually effective on the tool held in the tool holder 5 as an axial impact. Simultaneously therewith, the safety coupling which was described above and which consists of the gear wheel 41 and the rear flange 62 of the rotatable sleeve 58 drives the respective tool received in the tool holder 5, and more particularly the shank 6 thereof, in rotation.

The impacting mechanism 15 can be switched off, that is, its operation can be discontinued, in the above-discussed manner, by the operation of the switching eccentric 42 mounted on the switching shaft 43. Inasmuch as the air cushion impacting mechanism 15 is at a complete standstill under these circumstances, there is obtained an absolutely vibration-free operation of the impacting drill in its impact-free operational mode, that is, in its drilling mode of operation. It has been established that the tumbling disc drive can be switched in each operating condition of the impacting drill.

While in the construction described above in conjunction with FIGS. 1 to 4, which serves for the elucidation of the basic general construction of the impacting drill and its basic mode of operation, the tumbling angle is not adjustable, the construction of the impacting drill illustrated in FIGS. 5 to 10*d* is such that the stroke of the tumbling disc drive is adjustable by means of an adjustment of the tumbling angle with respect to the intermediate shaft.

In this latter construction as depicted in the drawing, the same reference numerals as used in connection with the basic construction illustrated in FIGS. 1 to 4, but increased by 100, are being used to identify corresponding parts. In order to eliminate the need for repetitious explanation of the construction and operation of the impacting drill of FIGS. 5 to 10*d*, this fact ought to be borne in mind and reference should be made in this respect to the preceding description.

The hub body 133 which rotates with the intermediate shaft 124 and which supports the ring 148 equipped with the tumbling finger 151 in a plane which is inclined with respect to the intermediate shaft 124 and indicated by the reference character A, is supported on a cylindrical holding body 163 of the intermediate shaft 124. The holding body 163 is inclined by an angle with respect to the intermediate shaft 124. In the drawing, the holding body 163 is shown to be integral or of one piece with the intermediate shaft 124. The hub body 133 is supported on the holding body 163 for turning relative thereto with simultaneous adjustment of the tumbling angle. The hub body 133 can be positively coupled with the holding body 163 in any of its relative turning positions with respect to the latter. This coupling function is performed, for instance, by approximately the same coupling elements as those described above in connection with FIGS. 1 to 4. Special details of such coupling elements will be described later on.

Figure 6:
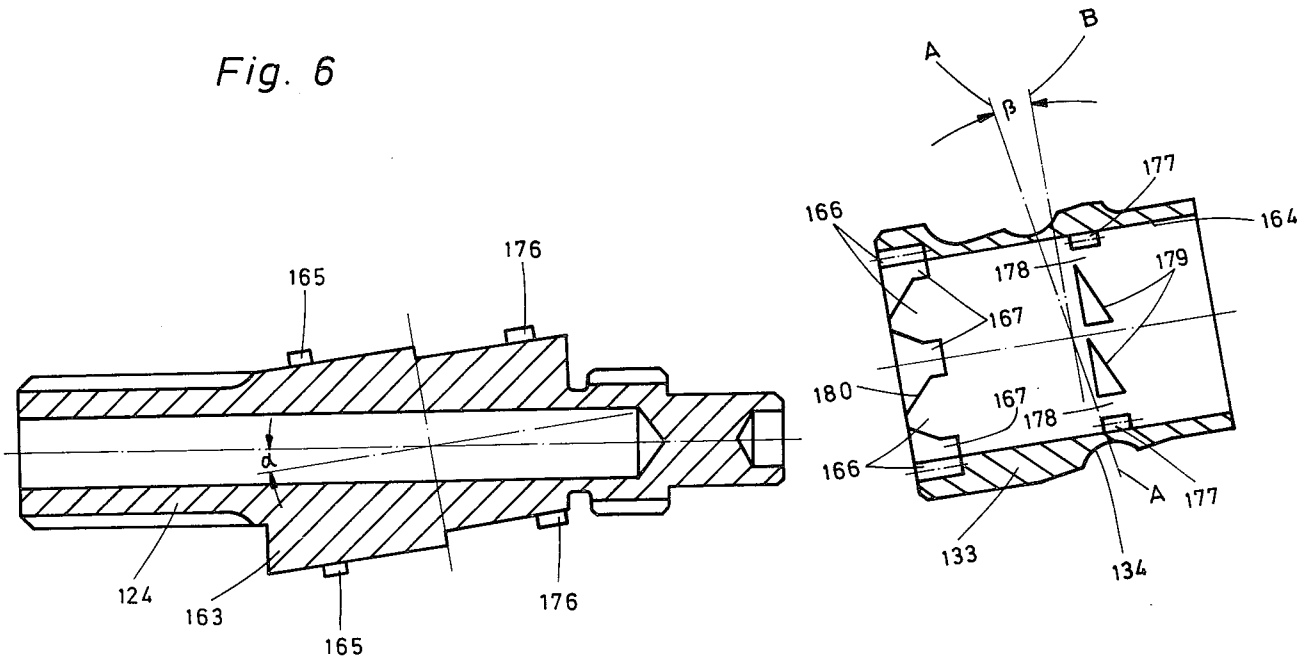
FIG. 6 is an exploded view of the shaft and the hub body of the arrangement of FIG. 5.
Figure 7:
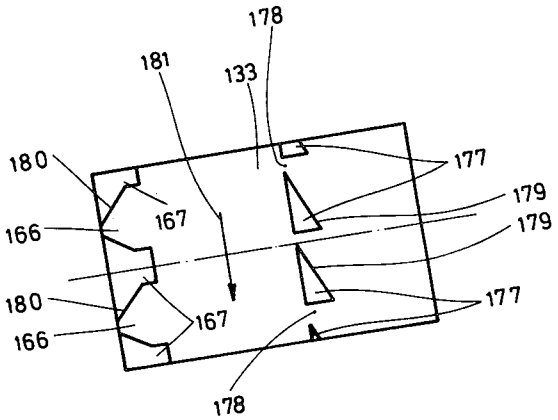
FIG. 7 is a diagrammatic view corresponding to that of FIG. 6 and showing the development of the cooperating regions.
Figure 7:
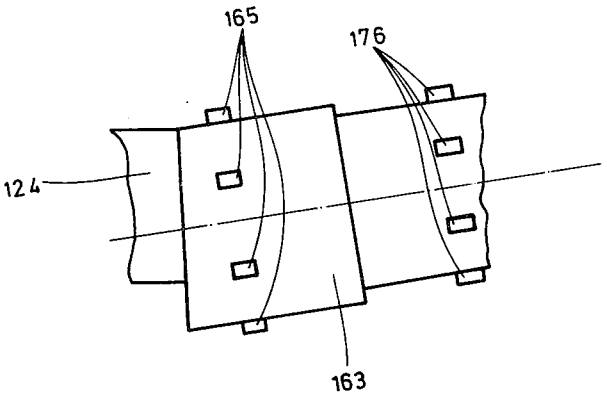
Figure 8:
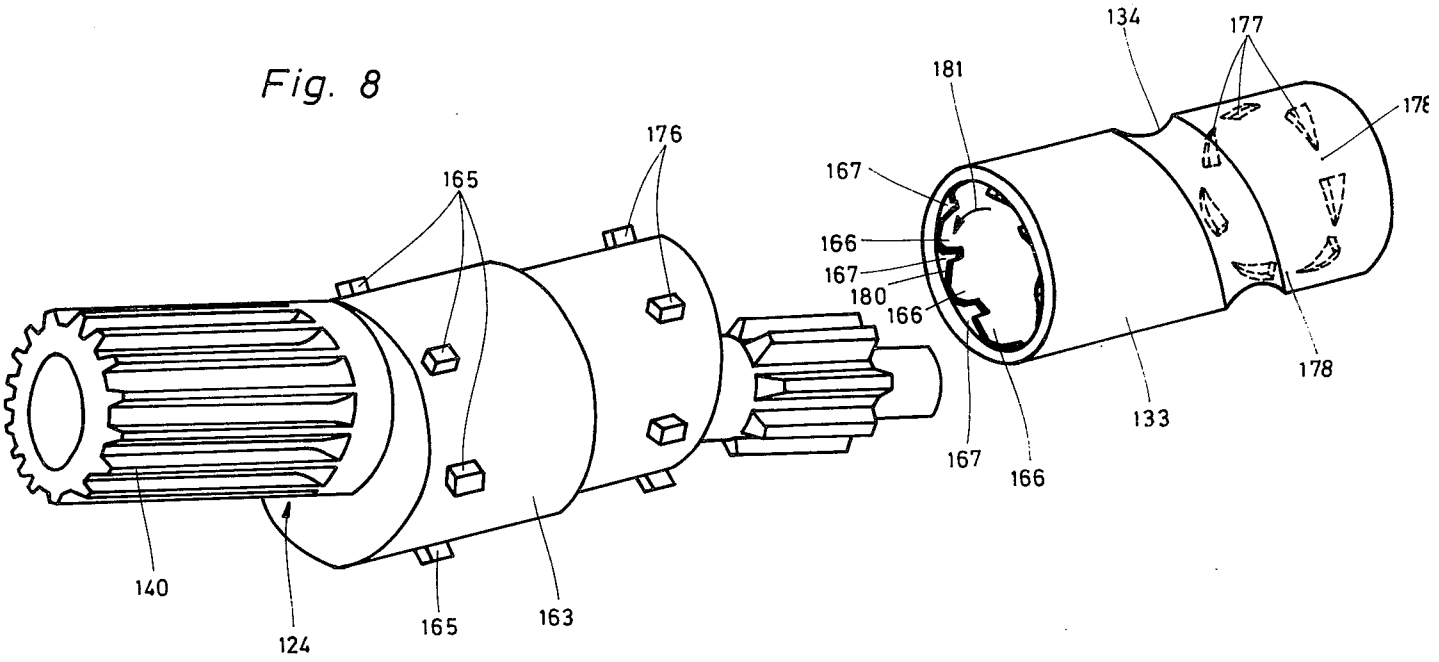
FIG. 8 is a perspective view corresponding to FIG.6.

The acute angle $\alpha$ which is indicated in FIG. 6 and at which the cylindrical holding body 163 is inclined with respect to the axis of the intermediate shaft 124 is at least approximately as large as a half of the maximum tumbling angle. The support plane A of the hub body 133 extends at an angle $\beta$ inclinedly with respect to a diametral plane B of a hub body bore 164, wherein the angle $\beta$ is also, in coordination with the angle $\alpha$, approximately as large as a half of the maximum tumbling angle. The angles $\alpha$ and $\beta$ are for example, equal to 8.5°.

While in a non-illustrated construction according to the present invention, the aforementioned coupling elements of the holding body 163 and of the hub body 133 can be constructed, for instance, as spheres or rollers or even as force-transmittingly engaging elements, the drawing shows a construction in which the coupling elements of the holding body 163 are constructed as radial claws which are arranged at equal circumferential angle distances from one another. However, axially extending claws could be used as well instead. Also, the hub body 133 carries, in a corresponding correlation, in its interior, axially and simultaneously radially inwardly projecting claws 166. The claws 166 are provided in the interior of the hub body 133 also at the same circumferential angle distances. The claws 166 of the hub body 133 define respective recesses 167, into which there extend, in the coupling position, the radial claws 165 of the holding body 163. The radial claws 165 can be brought out of engagement with the claws 166 of the hub body 133 by axially displacing the intermediate shaft 124 with the holding body 163 with respect to the hub body 133 against the opposition of the spring 128 which is thereby compressed.

A switching arrangement 168 is provided for this axial displacement of the intermediate shaft 124. The switching arrangement 168 operates basically in accordance with the same principle as the eccentric 42 described in connection with FIGS. 1 to 4. In the switching position, the switching arrangement 168 engages the axially displaceably mounted intermediate shaft 124 at its right-hand end as considered in FIG. 5, to displace the intermediate shaft in the leftward direction against the action of the compression spring 128. Herein, the extent of the axial displacement of the hub body 133 is limited, for instance, in that it abuts with its left-hand end as considered in FIG. 5 against the abutment 147 which is formed by the synthetic plastic material shell 102.

Figure 5:
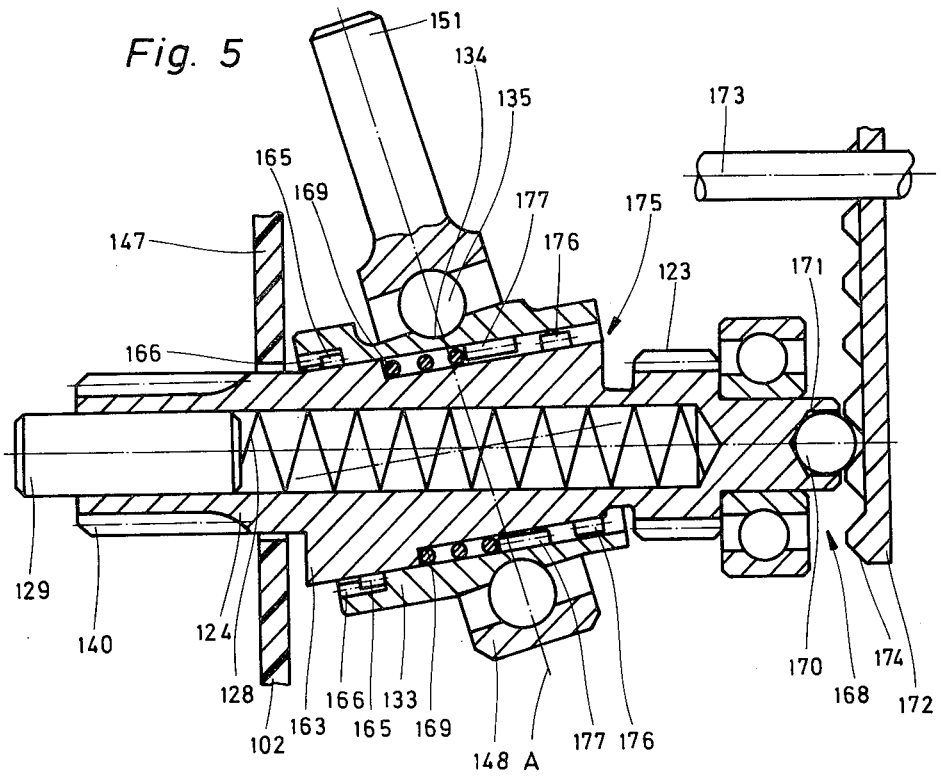
FIG. 5 is a partial axially sectioned view of a construction of the impacting arrangement of the invention.

In FIG. 5, there is also shown an advantageous modification which renders it possible to dispense with the abutment 147. In this modification, an axially effective compression spring 169 is arranged in the interior between the hub body 133, on the one hand, and the holding body 163 of the intermediate shaft 124, on the other hand, to serve as an axial movement limiter for the hub body 133. The compression spring 169 has only such a strength as to be able, during the axial displacement of the intermediate shaft 124, to overcome the static friction existing between the hub body 133 and the holding body 163 and thus to hold the holding body 163 in its axial position during the axial displacement of the intermediate shaft 124. When the switching force of the switching arrangement 168 is not applied, such as in the situation shown in FIG. 5, the return force of the spring 128 prevails so as to again displace the intermediate shaft 124 with the holding body 163 in the rightward direction into its original position, with simultaneous compression of the compression spring 169. In case that the switching force of the switching arrangement 168 is applied, the intermediate shaft 124 is displaced in the leftward direction as considered in FIG. 5. This leftward displacement is accompanied by uncoupling or disengagement of the radial claws 165 and the claws 166 which were previously in engagement. Then, the radial claws 165 assume their leftward position depicted in FIG. *9a*, in which they are out of engagement with the claws 166 and removed from the recesses 167. In this position, there exists the possibility of relative turning or angular displacement between the hub body 133 and the holding body 163 of the intermediate shaft 124, with attendant adjustment of the tumbling angle.

The switching arrangement 168 engages the intermediate shaft 124, by means of a sphere or ball 170. The ball 170 is accommodated in an axial opening 171 of the intermediate shaft 124. A construction of the switching arrangement 168 is shown in the drawing in which the arrangement 168 includes a switching wheel 172 which is actuatable by a handle that is accesible from the exterior of the impacting drill and which is not illustrated in the drawing. The switching wheel 172 is rotatable about an axle 173 which extends substantially parallel to and with transverse offset between the axes from the intermediate shaft 124, in an adjusting angular displacement about the axis of the axle 173. The switching wheel 172, can be arrested in the respectively selected position thereof by arresting members, for instance, spring-loaded arresting balls, which are not shown in the drawing, in order to obtain positive retention of the switching wheel 172 in the selected position. The switching wheel 172 is provided, along its peripheral portion, with axially protruding protuberances 174 bounding respective recesses therebetween. The protuberances 174 perform the function of an eccentric in that they fittingly receive the ball 170 in the respectively selected recess therebetween. In each instance when the switching wheel 172 is angularly displaced through an angle corresponding to the distance between two adjacent ones of the protuberances, the intermediate shaft 124 is displaced to the left as considered in FIG. 5 by an axial projection 174 via the ball 170. The relative turning movement can be accomplished during this displacement stroke which is accompanied by the disengagement of the radial claws 165 from the claws 166.

In another construction according to the present invention which is not shown in the drawing, the plane of turning of the switching wheel extends in the plane of the drawing. In this instance, the protuberances protrude in the radial direction of the switching wheel, and the latter is mounted for turning about an axis which is normal to the plane of the drawing and is situated at the elevation of the axis of the intermediate shaft 124, being again arrestable in any of the selected angular positions thereof.

In the axially displaced and uncoupled position of the intermediate shaft 124, the relative turning or angular displacement can be achieved by means of manual actuation, for instance, of the tool holder 5 which is shown in FIG. 5. In this case, the intermediate shaft 124 with the holding body 163 is turned about the axis thereof on turning of the tool holder 5, due to the driving transmission of the transmission elements of the impacting drill effective for accomplishing the "drilling" operation. However, it is even more advantageous to provide a step-type switching arrangement 175 arranged between the hub body 133 and the intermediate shaft 124 equipped with the holding body 163. By means of the step-type switching arrangement 175, it is possible to convert an axial switching displacement of the intermediate shaft 124, that is, axial displacement over one protuberance 174 of the switching wheel 172, into a stepped angular displacement of the hub body 133 relative to the intermediate shaft 124 and thus to the holding body 163.

In a construction which is not shown in the drawing, the step-type switching arrangement 175 can be constructed as a separate turning drive which causes, via an external handle, a turning motion, for example, of the hub body 133. In another construction according to the present invention, which is also not shown in the drawing, the step-type switching arrangement 175 is an integrated component of the switching arrangement 168. Under these circumstances, it effects the angular displacement of the intermediate shaft 124 with the holding body 163 relative to the hub body 133.

In the illustrated construction, the step-type switching arrangement 175 is arranged between the hub body 133 and the holding body 163 at an axial distance from the mutually cooperating coupling elements. It includes radial claws 176 on the holding body 163 which are grouped at the cylindrical outer periphery of the holding body 163 at equal angular distances from one another and which practically appear like the radial claws 165 at an axial distance therefrom. The above-described other elements can be provided instead of the radial claws 176, as well as an alternative to the radial claws 165.

Associated with the radial claws 176 are corresponding claws 177 arranged in the interior of the hub body 133, which project radially inwardly and axially toward the right as considered in FIGS. 5 and 6 to bound respective recesses 178 therebetween. The narrow face of each of the claws 177, which faces rightwardly as considered in FIGS. 5 and 6, is configurated as an inclined flank surface 179. During the axial displacement of the intermediate shaft 124 with the holding body 163, the radial claws 176 provided on the holding body 163, and more particularly their ends facing in the leftward direction as considered in FIGS. 5 and 6, follow these inclined flank surfaces 179. Owing to the inclined orientation of the flank surfaces 179, there becomes effective a force in the circumferential direction, which renders possible a relative angular displacement in the circumferential direction between the radial claws 176 and the claws 177. Inasmuch as ordinarily the intermediate shaft 124 with the holding body 163 is held against rotation when the aforementioned electric motor of the impacting drill is de-energized, the flank surfaces 179 of the claws 177 slide over the radial claws 176 with simultaneous angular displacement of the hub body 133 until the next following recess 178 between the claws is reached. In this manner, the hub body 133 is positionally adjusted relative to the intermediate shaft 124 through one adjustment step in the rotational direction. In order to render this switching adjustment possible, the radial claws 165 are moved out of engagement with the claws 166 during the axial displacement of the intermediate shaft 124.

To this end, the right-hand radial claws 176 of the holding body 163 as considered in FIGS. 5 and 6 are arranged at such an axial distance from the leftwardly situated radial claws 165 that, during positive coupling engagement as illustrated in FIG. 9*a*, in which the radial claws 165 are in positive engagement with the claws 166, the radial claws 176 of the step-type switching arrangement 175 are situated at a sufficiently large axial distance from the inclined flank surfaces 179 of the individual claws 177. During the axial displacement of the intermediate shaft 124 into the position illustrated in FIG. 9*b*, the radial claws 176 abut the inclined flank surface 179 of the claws 177, while the radial claws 165 become disengaged from the claws 166 of the hub body 133 due to the axial displacement. The above-discussed step-type switching arrangement 175 in some respects compares with mechanisms which are being used, for instance, in ball point pens.

In order to facilitate the coupling of the coupling elements after the completion of the switching step, while simultaneously assuring the maintenance of the relative angular position between the hub body 133 and the holding body 163 as achieved during the angular displacement, even the claws 166 in the hub body 133 are provided, at their leftwardly facing ends as considered in FIGS. 5 to 8, with inclined flank surfaces 180. Then, the radial claws 165 slide along these inclined flank surfaces 180 in the direction of the arrow 181, until they penetrate in the axial direction into the recesses 167 between the claws 166, to complete the angular displacement.

The inclinedly oriented flank surfaces 179, on the one hand, and the inclinedly oriented flank surfaces 180, on the other hand, extend, as considered in the circumferential direction and oppositely to the angular displacement direction 181, toward one another in a manner reminiscent of a wedge.

On the basis of operational conditions, the hub body 133 is ordinarily angularly displaced relative to the then stationary intermediate shaft 124. However, it is to be understood that the conditions can be easily kinematically reversed, when the intermediate shaft 124 is rotatable relative to the hub body 133.

In the position illustrated in FIG. 10*a*, the tumbling angle is equal to zero. Under these conditions, the impacting drill is operated in a so-called "impact-stop" mode of operation, which corresponds to the simple "drilling" mode. FIG. 10*b* shows the situation existing after the performance of a switching operation, that is, of a full axial stroke of the intermediate shaft 124 in the forward direction and back. Herein, the hub body 133 has been angularly displaced relative to the holding body 163 of the intermediate shaft 124 by 60°. The tumbling stroke amounts, for instance, to 52% of the maximum possible tumbling stroke.

In the position depicted in FIG. 10*c*, which has been achieved by the performance of a further switching operation, the hub body 133 has been angularly displaced relative to the holding body 163 through another 60°, as related to the original position thereof. The tumbling stroke now amounts to approximately 90% of the maximum possible tumbling stroke. In the position revealed in FIG. 10*d*, which has again been achieved by performing an additional switching operation, the hub body 133 is angularly displaced relative to the holding body 163 through 180° total as related to the initial position. Now, the hub body 133 is adjusted to perform the maximum possible tumbling stroke. When the switching operation is continued beyond this position, the tumbling stroke is again reduced, in the opposite succession to its previously described increase.

Figure 11:
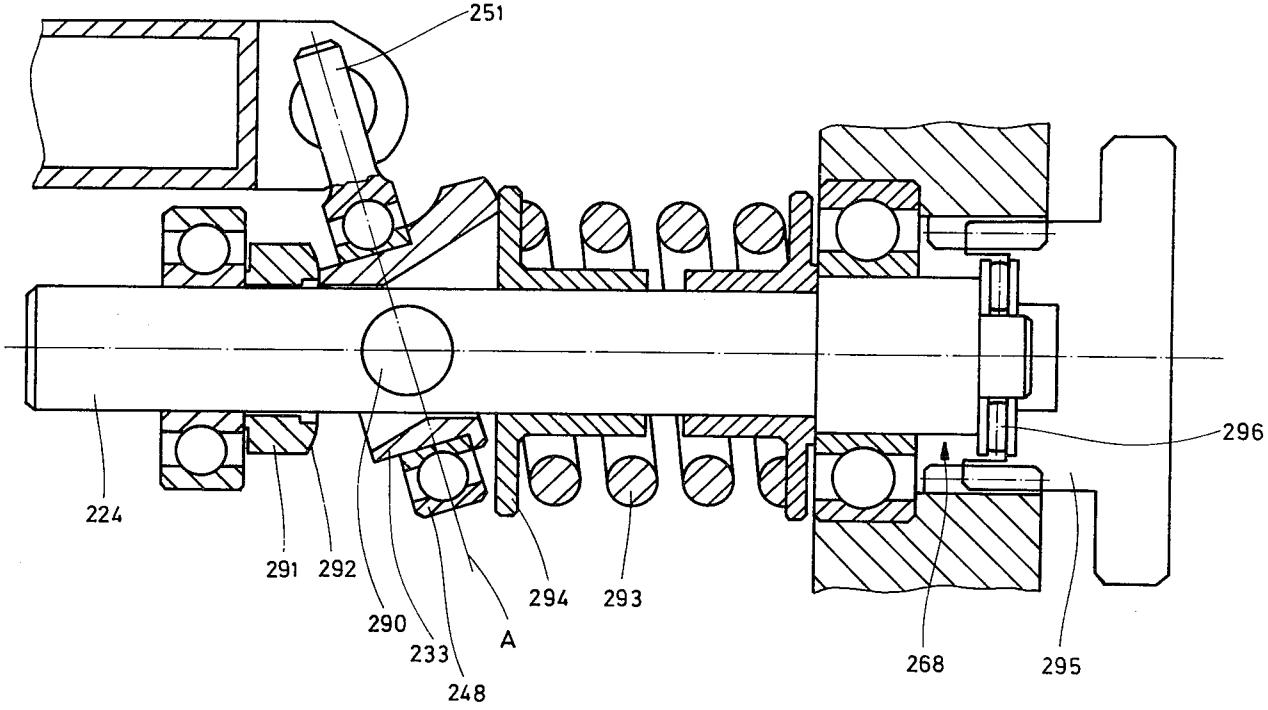
FIG. 11 is a view corresponding to that of FIG. 5 but of a modified construction of the impacting arrangement.

Another modified construction is illustrated in FIG. 11. In this construction, wherein corresponding parts are identified by the same reference numerals as just previously, but raised by another 100, the hub body 233 is pivotably mounted on the intermediate shaft 224 by means of a pivot pin 290. The axis about which this pivoting movement takes place extends transversely to the axis of the intermediate shaft 224 and simultaneously within the plane A of the ring 248 provided with the tumbling finger 251. The intermediate shaft 224 carries a support bushing 291 which is, for instance, axially relatively displaceable and supported on the housing of the impacting drill. The end of the support bushing 291 which faces toward the hub body 233 has a ball-shaped end face 292. The intermediate shaft 224 is additionally provided with an axial compression spring 293 which is axially supported on the intermediate shaft 224. The other end of the spring 293, that is, the leftward end as considered in FIG. 11, presses axially via a collar 294 against the hub body 233 and urges the latter against the ball-shaped end face 292 of the support bushing 291 in the axial direction.

Futhermore, there is provided a switching arrangement 268 which operates on the intermediate shaft 224. The switching arrangement 268 engages the right-hand end of the axially displaceably mounted intermediate shaft 224, as considered in FIG. 11, to displace the same in the leftward direction as considered in FIG. 11 with simultaneous adjustment of the tumbling angle. The switching arrangement 268 includes an adjustment screw 295 which acts on the end face of the intermediate shaft 224 through an axial or thrust bearing 296. The tumbling angle and thus the tumbling stroke is steplessly adjustable from zero to maximum by threading the adjustment screw 295 more or less deeply in. In the same manner as in the solution described above, even the switching arrangement 268 can be used, by the adjustment of the stroke to zero, for discontinuing the impacting mode of operation and thus for operating the impacting drill as a regular drill in a pure drilling operation, that is, in the so-called "impact-stop" mode of operation. It is especially advantageous in the two last discussed constructions that no reciprocating masses become effective when the stroke is set to zero, that is, when the impacting drill operates in its "impact-stop" mode of operation. In the last-discussed construction, there is obtained the additional advantage that no wear of any coupling elements interposed between the hub body and the holding body is encountered even after frequent switching. In this construction, the compression spring 293, which is here effective as an adjustment spring, is so arranged that it acts in the same direction as the mass forces, so that it does not increase the limiting pressure. The height of the air cushion is only insignificantly influenced by the adjustment of the stroke. The operating personnel is unable to adjust the stroke during the operation of the impacting drill due to the applied pressure. The impacting drill of the construction discussed in connection with FIGS. 4 to 10*d* has the same advantages.

It will be understood that each of the elements described above, or two or more together, may also find a useful application in other types of arrangements differing from the type described above.

While the invention has been illustrated and described as embodied in a hand-held impacting power drill, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. An impacting drill operative for rotating and selectively imparting impacts to a tool mounted thereon, comprising a support; an air cushion mechanism mounted on said support for reciprocation axially of the tool and operative for impacting the latter; and means for selectively reciprocating said air cushion mechanism, including a shaft mounted on said support for rotation about an axis offset from said air cushion mechanism, a holding member rigid with said shaft and centered on an adjustment axis enclosing a first acute angle with said axis, means for rotating said shaft about said axis, a tumbling mechanism including a hub body mounted on said holding member for angular displacement about said adjustment axis between a plurality of angular positions, a ring-shaped tumbling member extending around said shaft along a tumbling plane and having a portion that is in force-transmitting engagement with said air cushion mechanism, and means for so mounting said tumbling member on said hub body that said tumbling plane encloses a second acute angle with a plane normal to said adjustment axis, and means for so releasably connecting said hub body of said tumbling mechanism to said shaft for joint rotation therewith in any of said angular positions that said tumbling plane rotates with said shaft and said portion of said tumbling member swivels in a plane extending in the direction of reciprocation of said air cushion mechanism within an angular range depending on the angular position of said hub body of said tumbling mechanism on said holding member and thus on the resulting angle enclosed between said tumbling plane and said axis of said shaft.

2. The impacting drill as defined in claim 1, wherein said air cushion mechanism includes a driving member, an impacting member, and means for forming an air cushion between said driving and impacting members; and wherein said portion of said tumbling member engages said driving member.

3. The impacting drill as defined in claim 1, wherein the said first acute angle amounts at least to one-half of the maximum angular range of swivelling movement of said portion of said tumbling member.

4. The impacting drill as defined in claim 3, wherein said first angle amounts to about 8.5°.

5. The impacting drill as defined in claim 3, wherein said second acute angle amounts at least to one-half of the maximum angular range of swivelling movement of said portion of said tumbling member.

6. The impacting drill as defined in claim 5, wherein said second acute angle amounts to about 8.5°.

7. The impacting drill as defined in claim 1, wherein said hub body and said shaft with said holding member are displaceable relative to one another in the axial directions of said shaft; and wherein said releasable connecting means includes respective sets of male and female formations respectively mounted on said shaft with said holding member and on said hub body and engageable with one another on relative displacement in one, and disengageable from each other on relative displacement in the other, of said axial directions.

8. The impacting drill as defined in claim 7, wherein said male formations include rollers.

9. The impacting drill as defined in claim 7, wherein said male formations include balls.

10. The impacting drill as defined in claim 7, wherein said male formations include claws.

11. The impacting drill as defined in claim 7, wherein said male formations include teeth.

12. The impacting drill as defined in claim 7, and further comprising spring means for biasing said shaft with said holding member and said hub body relative to one another in said one axial direction for holding said sets of formations in engagement with one another.

13. The impacting drill as defined in claim 12, wherein said hub body is mounted on said support for at most a limited movement in the axial direction of said shaft; wherein said shaft with said holding member is mounted on said support for said axial displacement relative to said hub body; wherein said spring means includes at least one spring acting in said one axial direction on said shaft; and further comprising a switching mechanism movable between its inactive and active position and engaging said shaft with said holding member and displacing the same against the action of said spring during its movement toward its active position.

14. The impacting drill as defined in claim 13, and further comprising means for limiting the extent of movement of said hub body relative to said support axially of said shaft, including at least one abutment rigid with said support and extending into the trajectory of axial movement of said hub body relative to said shaft.

15. The impacting drill as defined in claim 13, and further comprising means for limiting the extent of movement of said hub body relative to said shaft with said mounting member axially of said shaft, including an axial compression spring extending between said shaft with said holding member and said hub body.

16. The impacting drill as defined in claim 15, wherein said compression spring extends between said hub body and said holding member.

17. The impacting drill as defined in claim 13, and further comprising a ball-shaped element interposed between said switching mechanism and said shaft and supported on the latter.

18. The impacting drill as defined in claim 17, wherein said ball-shaped element is seated in an axial opening of said shaft.

19. The impacting drill as defined in claim 13, wherein said switching mechanism includes at least one switching eccentric operative for axially displacing said shaft in said other axial direction toward said inactive position.

20. The impacting tool as defined in claim 19, wherein said switching mechanism includes a manually actuatable switching wheel having a set of protuberances on its periphery and rotatably supported on said support in such a position that said protuberances move in a trajectory interfering with the path of axial displacement of said shaft to displace the latter into said inactive position thereof.

21. The impacting drill as defined in claim 20, wherein said switching wheel is rotatable about an additional axis parallel to and transversely offset from said axis of said shaft; and wherein said protuberances protrude from one end face of said switching wheel in one axial direction.

22. The impacting drill as defined in claim 20, wherein said switching wheel is rotatable about an additional axis transverse to said axis of said shaft at the level of the latter; and wherein said protuberances protrude from the periphery of said switching wheel in the radial direction.

23. The impacting drill as defined in claim 13, further comprising a chuck operative for mounting the tool on said support for rotation about a tool axis; and a transmission interposed between said chuck and said shaft and operative for angularly displacing said shaft about its axis relative to said hub body in response to manual turning of said chuck about said tool axis with said shaft in said inactive position thereof due to the action of said switching mechanism thereon.

24. The impacting drill as defined in claim 13, and further comprising a stepping mechanism interposed between said hub body and said shaft with said holding member and operative for converting the axial displacement of said shaft into stepped angular displacement of said hub body about said adjustment axis.

25. The impacting drill as defined in claim 24, wherein said stepping mechanism is an integral part of said switching mechanism.

26. The impacting drill as defined in claim 24, wherein said stepping mechanism includes claws on said holding member and associated claws in said hub body each of which has an inclined flank engaged by the respective claw of said holding member during the axial displacement of said shaft with said holding member for angularly displacing said hub body about said adjustment axis by one step during each cycle of said axial displacement.

27. The impacting drill as defined in claim 26, wherein said claws are so situated relative to said formations that, in said active position in which said formations engage one another, said claws of said holding member are spaced by a predetermined axial distance from said inclined flanks of said associated claws of said hub body to engage the same only after relative axial displacement by at least said predetermined axial distance in said other axial direction, during which said formations became disengaged from one another.

28. The impacting drill as defined in claim 27, wherein said formations have respective inclined flanks.

29. The impacting drill as defined in claim 28, wherein said claws and said formations of said hub body are arranged in the interior of said hub body substantially at the opposite axial end portions of the latter.

30. The impacting drill as defined in claim 28, wherein said inclined flanks of said formations and those of said claws of said hub body extend toward one another as considered in one circumferential direction.

* * * * *